US005906476A

United States Patent [19]

Arlton

[11] Patent Number: 5,906,476

[45] Date of Patent: May 25, 1999

[54] MAIN ROTOR SYSTEM FOR HELICOPTERS

[76] Inventor: Paul E. Arlton, 1132 Anthrop Dr., West Lafayette, Ind. 47906

[21] Appl. No.: 08/855,202

[22] Filed: May 12, 1997

Related U.S. Application Data

[60] Division of application No. 08/233,159, Apr. 25, 1994, Pat. No. 5,628,620, which is a continuation-in-part of application No. 07/770,013, Sep. 30, 1991, Pat. No. 5,305,968.

[51] Int. Cl.[6] ..... B64C 27/605

[52] U.S. Cl. ..... 416/114; 416/141; 416/244 R; 416/246; 384/513; 384/537

[58] Field of Search ..... 416/113, 114, 416/115, 141, 148, 168 R, 244 R, 246; 74/60; 384/513, 537, 208

[56] References Cited

U.S. PATENT DOCUMENTS

| | | | |
|---|---|---|---|
| 1,255,378 | 2/1918 | Beach | 384/537 |
| 1,497,302 | 6/1924 | Ray | 416/114 |
| 1,870,928 | 8/1932 | Smith . | |
| 2,021,481 | 11/1935 | Dornier . | |
| 2,086,802 | 7/1937 | Hays . | |
| 2,311,247 | 2/1943 | Pitcairn . | |
| 2,384,516 | 9/1945 | Young . | |
| 2,614,640 | 10/1952 | Buivid . | |
| 2,631,679 | 3/1953 | Hiller, Jr. et al. . | |
| 2,689,099 | 9/1954 | Lightfoot . | |
| 2,919,753 | 1/1960 | Hook | 416/114 |
| 3,004,736 | 10/1961 | Culver . | |
| 3,027,948 | 4/1962 | Goland et al. . | |
| 3,108,641 | 10/1963 | Taylor . | |
| 3,211,235 | 10/1965 | Bretl . | |
| 3,228,478 | 1/1966 | Edenborough . | |
| 3,232,348 | 2/1966 | Jarosch . | |
| 3,528,633 | 9/1970 | Knemeyer . | |
| 3,532,302 | 10/1970 | Dean . | |
| 4,118,143 | 10/1978 | Kavan . | |
| 4,195,966 | 4/1980 | Cornelius . | |
| 4,272,041 | 6/1981 | Mabuchi et al. . | |
| 4,419,051 | 12/1983 | DeRosa . | |
| 4,588,355 | 5/1986 | Ferris et al. | 416/114 |
| 4,738,592 | 4/1988 | Cavanaugh . | |
| 4,759,514 | 7/1988 | Burkam . | |
| 4,792,244 | 12/1988 | Yamashita et al. | 384/537 |
| 5,252,100 | 10/1993 | Osawa et al. . | |
| 5,322,415 | 6/1994 | White et al. . | |

FOREIGN PATENT DOCUMENTS

| | | | |
|---|---|---|---|
| 0466503 | 7/1950 | Canada . | |
| 0080292 | 6/1983 | European Pat. Off. . | |
| 0126370 | 7/1959 | U.S.S.R. . | |
| 317314 | 3/1930 | United Kingdom | 384/537 |
| 0452407 | 8/1936 | United Kingdom . | |
| 0623474 | 5/1949 | United Kingdom . | |

OTHER PUBLICATIONS

Enforcer ZR—assembly instructions, five page instruction set for assembling control system produced by Kalt. Date unknown.

Rebel—basic assembly manual, four page instruction set for assembling a helicopter. Date unknown.

Champion—building plan, two page assembly drawing by Champion. Date unknown.

(List continued on next page.)

*Primary Examiner*—Christopher Verdier

*Attorney, Agent, or Firm*—Barnes & Thornburg

[57] ABSTRACT

A swashplate is provided for use in helicopters having a vertical main rotor axis. The swashplate includes a bearing, a first race member including a channel, a second race member including a channel, and a third race member including a channel. The channels of the first, second, and third race members cooperate to form a bearing-receiving slot. The bearing is positioned to lie in the bearing-receiving slot. The first and second race members are adjustably coupled to change the respective positions of their channels.

42 Claims, 10 Drawing Sheets

OTHER PUBLICATIONS

Mini–Boy—building plan, two page assembly drawing by Mini–Boy. Date unknown.

XL–PRO—building plan, three page brochure by Miniature Aircraft USA. Date unknown.

*R/C Feel Out The Helicopters A to Z*, two page sales brochure for model helicopters produced by Kyosho Co. of Kanagawa Prefecture. Date unknown. Illustrations in brochure show the structure of the helicopter including the main rotor, tail rotor, frame and landing gear.

Information concerning the Graupner Heim helicopter contained in *Neuheiten* '91, pp. 22–23. Illustrations show the structure of the helicopter including the main rotor, frame, and landing gear.

Building instructions for the Champion model helicopter produced by Hubschrauber Schluter. Two pages. Date unknown.

Building Plans for X–Cell thirty and forty series model helicopter produced by Miniature Aircraft USA, 1989, two pages.

Sales brochure for the Petit Helicopter, Sports Flight Helicopter, and helicopter accessories contained in the sales catalog for Hirobo Limited. Three pages. Date unknown.

Sales brochure for the Whisper Electric helicopter distributed by Hobby Dynamics Distributors. One page. Date unknown.

*Rotary Modeler*, May/Jun., 1992. One page.

Rock, Gene, SSP–5, *American Aircraft Modeler*, Mar., 1973, pp. 41–45 and 76–79.

MAIN ROTOR SYSTEM FOR HELICOPTERS

BACKGROUND AND SUMMARY OF THE INVENTION

This application is a divisional application of U.S. application Ser. No. 08/233,159, filed Apr. 25, 1994, now U.S. Pat. No. 5,628,620, which is a continuation-in-part application of U.S. application Ser. No. 07/770,013, filed Sep. 30, 1991, now U.S. Pat. No. 5,305,968.

The present invention relates to the field of thrust-producing rotor systems for both model and full-size helicopters, and particularly to main rotor control systems. More particularly, the present invention relates to swashplates for helicopter main rotor systems.

Helicopters are flying machines with the ability to hover and fly forwards, backwards, and sideways. This agility stems from the multiple capabilities of the main rotor system. Since the invention of helicopters in the 1930's considerable effort has been expended advancing helicopter technology, with a substantial percentage of that effort concentrated on the main rotor system.

While the technology of fill-size helicopters progressed, model helicopters remained impractical for decades for lack of suitable engines, radio control equipment, and construction materials. As the state-of-the-art in full-size helicopters advanced in the 1950's and 1960's, many novel model helicopter designs were developed, but none proved practical. Model helicopter designers often copied the designs of full-size helicopters without understanding the basic differences between full-size and model aircraft. As a result, scaled-down model helicopters were typically unstable and underpowered. While mechanically similar, the aerodynamics, operational speeds, and weights of model helicopters are vastly different from those of their full-size counterparts.

In the 1970's hobbyists developed the first practical model helicopters. Lighter radio control equipment, more powerful engines, and systematic engineering all contributed to early successes. Much of model helicopter design, however, is rooted in tradition. Even though helicopter technology has advanced considerably since that time, the designs and design philosophies of that era are still in widespread use. With an better understanding of small-scale aerodynamics and kinematics, it is possible to devise a model helicopter rotor system with capabilities beyond those currently available. Certain aspects of the rotor system can benefit full-scale aircraft.

A main rotor system is mounted on a helicopter and configured to lift the helicopter into the air. Because the main rotor system of a helicopter is capable of performing so many flight functions, it is usually very mechanically complex. Many model helicopters currently available contain myriad pushrods, mixing arms, ball joints, and expensive ball bearings.

A swashplate assembly is used to transmit pilot control commands to helicopter rotor blades included in the main rotor system of a helicopter. What is needed is a simplified swashplate assembly.

According to the present invention, a swashplate is provided for use in helicopters having a vertical main rotor axis. The swashplate includes a plurality of ball bearings, an inner race member engaging the ball bearings to define an inner side of a ball bearing-receiving channel, and first and second outer race members cooperating to engage the ball bearings to define an outer side of a ball bearing-receiving channel.

The first and second outer race members are movable relative to one another to change the size of the ball bearing-receiving channel.

In preferred embodiments, the inner race member is a sleeve that is formed to include an inner ball bearing-receiving channel. The first outer race member is a ring that is formed to include a upwardly-facing channel and the second outer race member is a cap that is formed to include a downwardly-facing channel. The upwardly-facing channel and the downwardly facing channel cooperate to form an outer ball bearing-receiving channel that along with the inner ball bearing-receiving channel of the inner race member cooperate to form an annularly-extending ball bearing-receiving slot and the plurality of ball bearings are positioned to lie in the annularly-extending ball bearing-receiving slot. The first outer race member and the second outer race member are coupled to allow for adjustment of the relative position of the first outer race member and the second outer race member.

A swashplate kit that includes the swashplate and an anti-rotational pin is provided. The first outer race member of the swashplate further includes an anti-rotational pin-receiving detent and the anti-rotational pin is sized to fit within the anti-rotational pin-receiving detent. During adjustment of the relative position of the first and second outer race members, the anti-rotational pin is positioned to lie in the anti-rotational pin-receiving detent of the first outer race member to fix the first outer race member in relative motion to the inner race member. The anti-rotational pin is then removed from the anti-rotational pin-receiving detent during operation of the helicopter.

A method of adjusting the size of a ball bearing-receiving chamber in a swashplate for use in a main rotor system of a helicopter is provided. The method includes the steps of providing a swashplate including an inner race member, a two-part outer race member, and a plurality of ball bearings between the inner and outer race members and moving one part of the outer race member to change the size of the ball bearing-receiving chamber so as to adjust ball bearing play in the swashplate.

In preferred embodiments, this method of adjusting ball bearing play within the swashplate includes the steps of providing a swashplate including a first outer race member fixed to a second outer race member to rotate therewith, releasing the first and second outer race members for relative motion therebetween, adjusting the relative position of the first and second outer race members, and re-establishing a fixed connection between the first and second outer race members so that the first outer race member again is fixed to the second outer race member to rotate therewith.

A main rotor system for use in a helicopter including a swashplate and a bearing block that is attached to the helicopter and configured to include a bearing block base, a swashplate stalk coupled to the bearing block base, and a swashplate universal ball coupled to the swashplate stalk. The swashplate universal ball supports the swashplate and allows for universal motion of the swashplate.

Additional features of the invention will become apparent to those skilled in the art upon consideration of the following detailed description of preferred embodiments exemplifying the best mode of carrying out the invention as presently perceived.

BRIEF DESCRIPTION OF THE DRAWINGS

The detailed description particularly refers to the accompanying figures in which.

DETAILED DESCRIPTION OF THE DRAWINGS

Figure 1:
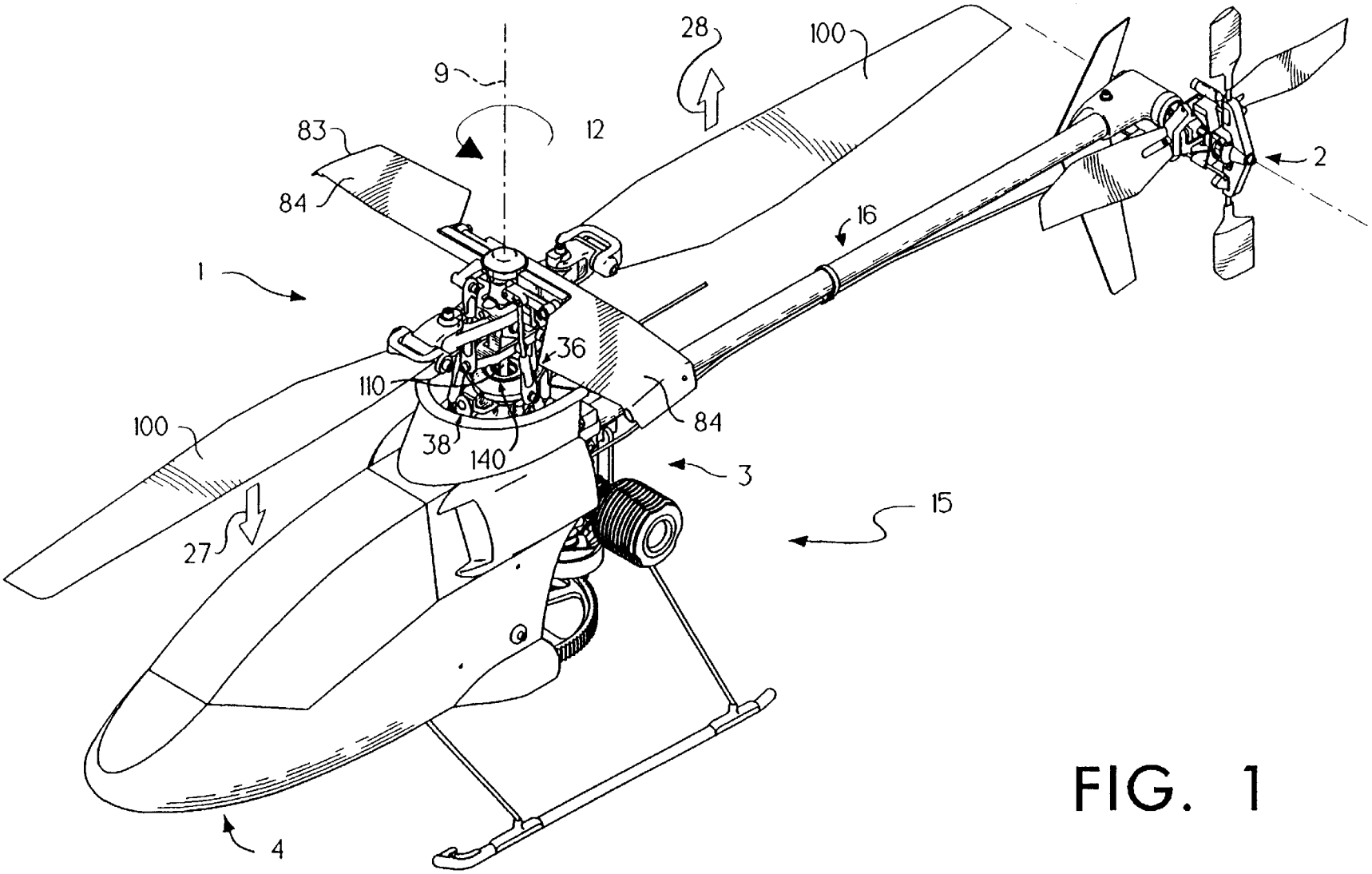
FIG. 1 is a perspective view of a model helicopter including a helicopter body, a tail rotor coupled to the helicopter body, and a main rotor system coupled to the helicopter body.

Referring to FIG. 1, a helicopter 15 in accordance with the present invention includes a large main rotor 1 which lifts the helicopter 15 into the air and a smaller tail rotor 2 which is used to counteract the torque produced by main rotor 1 and to steer the helicopter 15. Main rotor 1 rotates about vertical axis 9 and includes a pair of rotor blades 100 and a pair of shorter subrotor blades 84. Both main rotor 1 and tail rotor 2 are driven by an engine 3 usually located within the helicopter fuselage (body) near the vertical main rotor shaft 9. A streamlined fuselage shell 4 illustratively covers the front of the helicopter 15 without extending back along a tail boom 16 to the tail rotor 2. The subject matter in application Ser. Nos. 08/233,159, now U.S. Pat. No. 5,628,620 and 07/770,013, now U.S. Pat. No. 5,305,968 is hereby incorporated by reference herein. Reference is made to the specification in application Ser. No. 08/855,202 filed on May 12, 1997 which is hereby incorporated by reference herein for descriptions of other aspects of a main rotor system for helicopters.

From a distance, helicopter main rotors look superficially like large propellers sitting atop the helicopter fuselage. Like propellers, helicopter main rotors are designed to produce a thrust or lift force. Helicopter main rotors, however, operate in a manner completely different from propellers. Unlike propellers, they are designed to move through the air sideways; the lift force which keeps the helicopter aloft can also be directed to push the helicopter in any direction.

Figure 2:
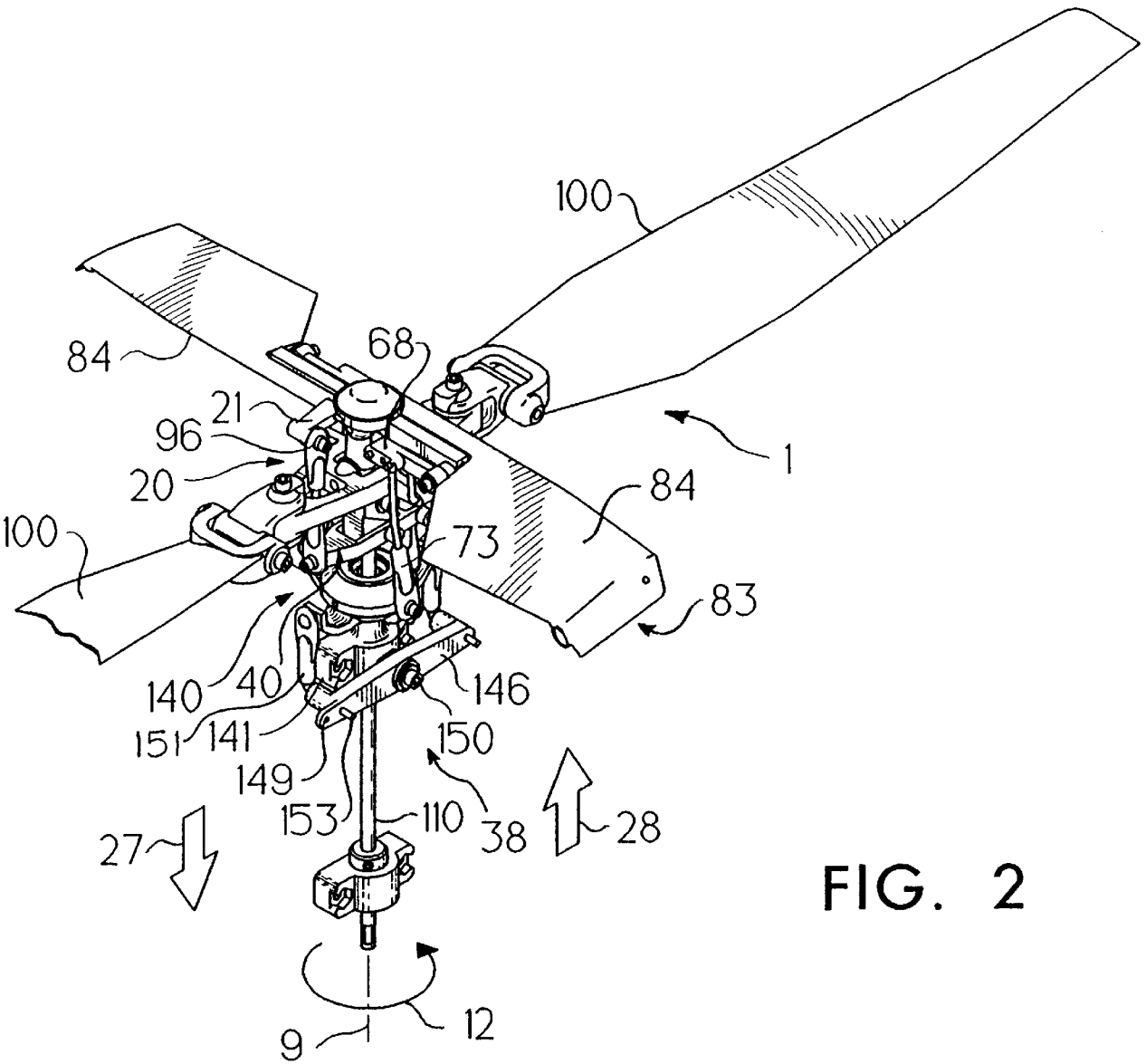
FIG. 2 is an enlarged perspective view of the main rotor system of FIG. 1 with all other parts of the helicopter removed for clarity showing the main rotor system including a vertical main rotor shaft extending along a vertical main rotor axis, main rotor blades attached to the main rotor shaft, subrotor stabilizer blades attached to the main rotor shaft, a swashplate attached to the main helicopter body, and a series of linkages that transmit pilot control commands from the non-rotating helicopter main body through the swashplate, and to the rotating main rotor blades and subrotor stabilizer blades.

Referring now to FIG. 2, in operation, engine 3 causes main rotor 1 to rotate rapidly about shaft axis 9 on rotor shaft 110 in rotor rotation direction 12. As it does so, rotor blades 100 and subrotor blades 84 act like propellers or fans moving large amounts of air in downward direction 27, thereby creating a force that lifts helicopter 15 upward in direction 28. In order to control helicopter 15 in horizontal flight, the pilot causes rotating main rotor 1 to tilt slightly in one direction or another relative to rotor shaft 110. The offset lift force produced by the tilted main rotor causes the helicopter to move horizontally in the direction of the tilt.

Since main rotor 1 on helicopter 15 rotates while the fuselage or body 4 of the helicopter 15 does not, some mechanism is needed to transmit control commands from the non-rotating pilot to rotating main rotor 1. Main rotor 1 includes a swashplate 140, non-rotating linkages 38, and rotating linkages 36 to transmit control commands from the non-rotating pilot to rotating main rotor blades 100 and subrotor stabilizer blades 84. In order to tilt main rotor 1, the pilot moves linkages attached to swashplate 140 which in turn are connected through linkages to rotor blades 100 and subrotor blades 84. The lower portion of swashplate 140 is attached to the helicopter fuselage structure and does not rotate with main rotor 1, while the upper portion is connected to and rotates with main rotor 1.

Traditionally, the pilot of a full-size helicopter controls the main rotor by manipulating a joystick called the "cyclic" control located in front of the pilot and a lever called the "collective" control located to the left of the pilot. Cables, push-pull rods, and bellcranks connect the cyclic and collective controls through the swashplate to the pitch controls of the main rotor blades.

Main rotor systems of most radio-controlled model helicopters operate in an manner similar to full-size helicopters. The pilot manipulates small joysticks on a hand-held radio transmitter which in turn sends commands to electromechanical servo actuators located within the flying model. Push-pull rods and bellcranks connect the servos through the swashplate to the pitch controls of the main rotor blades.

Figure 3:
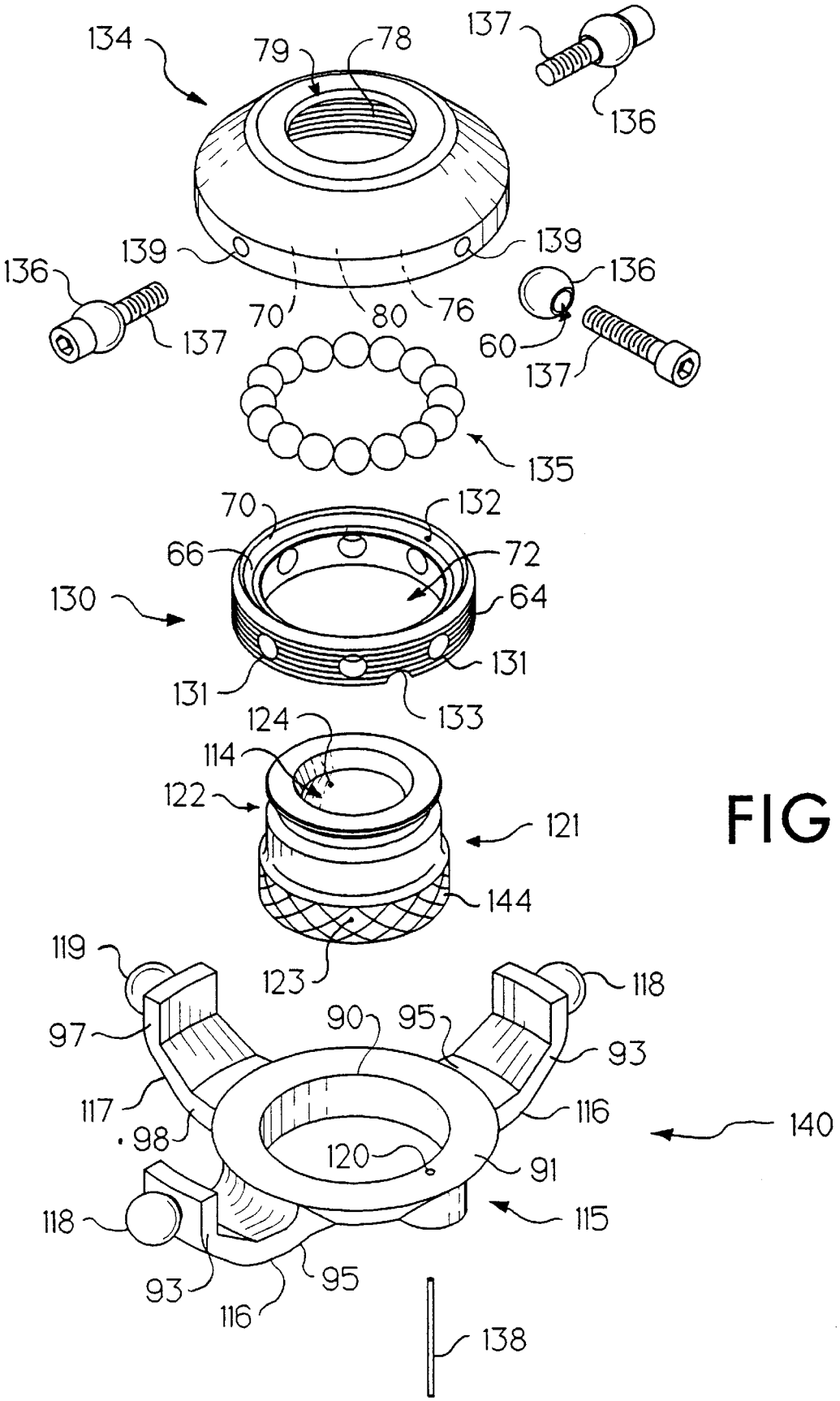
FIG. 3 is an exploded perspective view of a swashplate of the main rotor system of FIGS. 1 and 2 showing the swashplate including first and second outer race members, race locking bolts, swashplate ball-links, a plurality of ball bearings, an inner race member, a swashplate arm body, and an anti-rotational locking pin.

To control the main rotor, pilot commands are transmitted through a swashplate 140 shown, for example, in FIGS. 1, 2, 7, and 8. As shown in FIG. 3, the swashplate 140 of the present invention includes swashplate arms 115, inner race sleeve or non-rotating inner race member 121, race ring or rotating first outer race member 130, a plurality of ball bearings 135, outer race cap or rotating second outer race member 134, swashplate ball-links 136, and race locking bolts 137. In the preferred embodiment of the current invention inner race sleeve 121, race ring 130, and outer race cap 134 are manufactured from aluminum alloy. Referring again to FIGS. 3 and 4, swashplate 140 of the present invention includes swashplate arm body 115, non-rotating inner race member 121 attached to swashplate arm body 115, rotating first outer race member 130, rotating second outer race member 134 adjustably attached to rotating first outer race member 130, and a plurality of ball bearings 135.

Swashplate arms 115 comprise fore-and-aft cyclic arms 116 terminating in fore-and-aft ball-links 118, roll arm 117 terminating in roll ball-link 119, and check-pin through-hole or anti-rotational pin-receiving aperture 120. Inner race sleeve 121 has circumferential inner race slot or inner ball bearing-receiving channel 122 receptive to ball bearings 135, and knurl pattern 123 externally, and is generally cylindrical with a semi-spherical top 124 internally. Race ring 130 includes a plurality of locking holes or bolt-receiving apertures 131 and a ring notch or anti-rotational pin-receiving detent 133, and is threaded about the exterior circumference. Race ring upper surface 132 is contoured to form the lower part of the outer race. Outer race cap 134 has a plurality of threaded holes or threaded bolt-receiving apertures 139, is contoured internally to form the upper part of the outer race, and is threaded about the interior circumference.

Rotating first outer race member 130 is ring-shaped and includes upper surface 132 generally facing in upward direction 28 toward main rotor blades 100 and a threaded exterior surface 64 facing away from vertical main rotor axis 9. Upper surface 132 is contoured to form an upwardly-facing channel 66. Rotating first outer race member 130 is also formed to include anti-rotational pin-receiving detent 133, an inner race-receiving aperture 72, and plurality of bolt-receiving apertures 131.

Rotating second outer race member 134 is cap-shaped and includes an interior top surface 76 generally facing in downward direction 37 away from main rotor blades 100, a threaded interior surface 78 facing toward vertical main rotor axis 9, and is formed to include a plurality of threaded bolt-receiving apertures 139, as shown in FIGS. 3, 4, 7, and 8. Interior top surface 76 is contoured to form a downwardly-facing channel 80 and also formed to include a shaft-receiving aperture 79. Upwardly-facing channel 66 of first outer race member 130 cooperates with downwardly-facing channel 80 of rotating second outer race member 134 to form an outer ball bearing-receiving channel 70. Outer ball bearing-receiving channel 70 includes a width 86 measured between downwardly- and upwardly-facing channels 80, 66, as shown in FIGS. 7–10.

Figure 4:
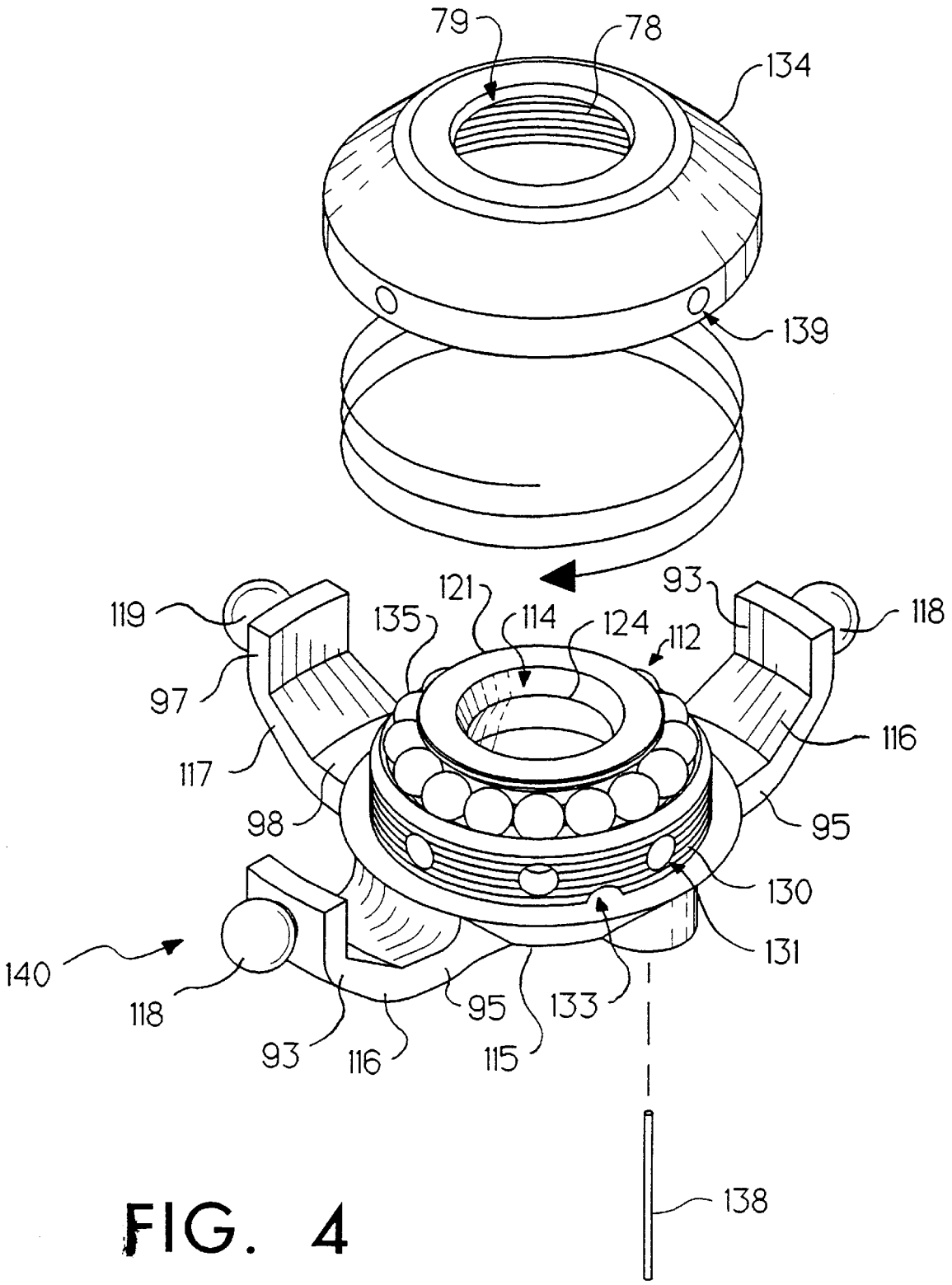
FIG. 4 is a view similar to FIG. 3 showing the swashplate arm body being coupled to the inner race member, the first outer race member being positioned to lie on the swashplate arm body, the inner race member and the first outer race member cooperating to form an annularly-extending ball bearing-receiving slot, the plurality of ball bearings being positioned to lie in the annularly-extending ball bearing-receiving slot, and the second outer race member being positioned to become adjustably attached to the first outer race member.

Referring to FIGS. 3 and 4, in the preferred embodiment of the current invention, swashplate arms 115 are made of a plastics material such as nylon and are molded directly around knurl pattern 123 and are thereby permanently secured to inner race sleeve 121.

Figure 7:
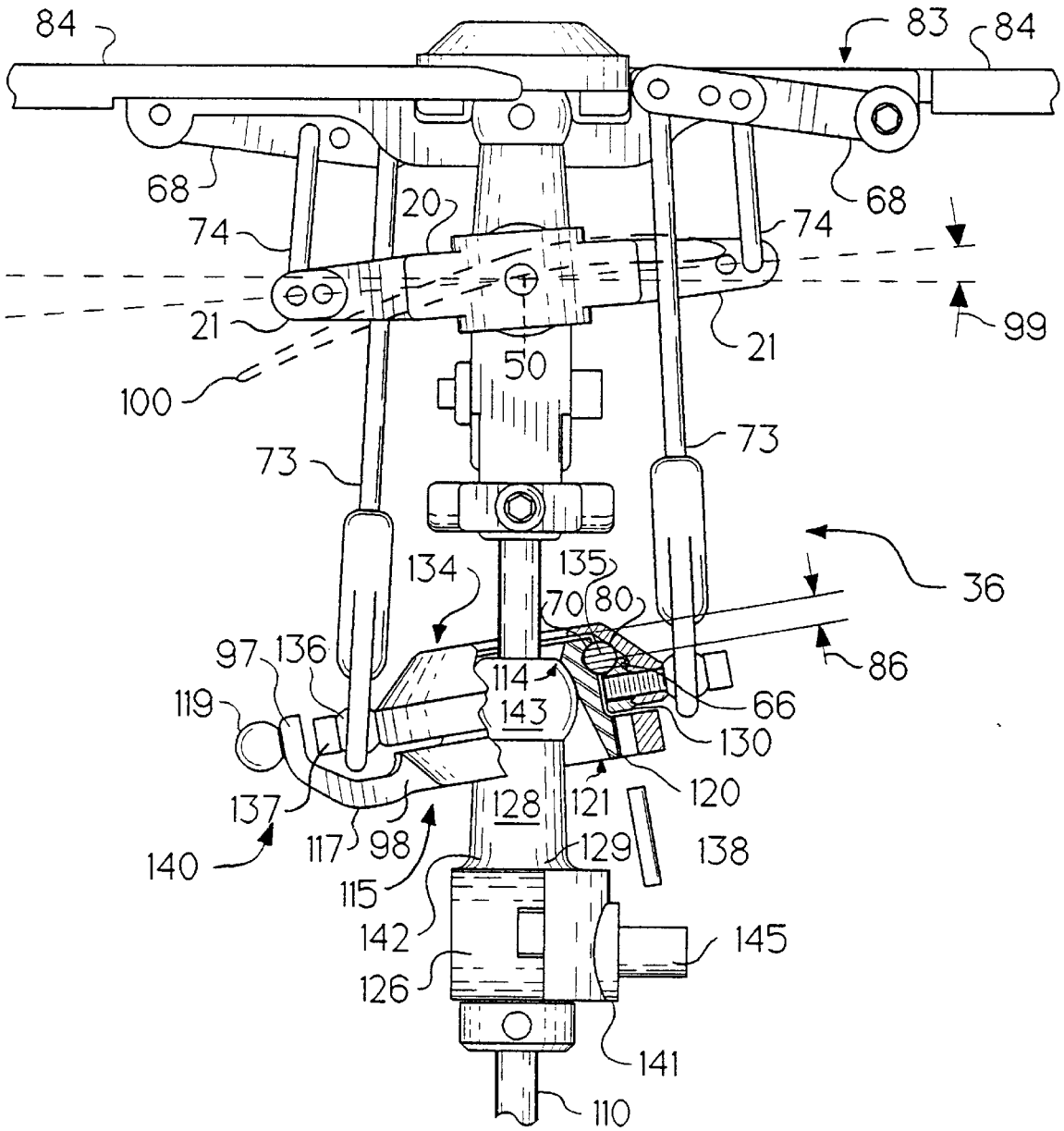
FIG. 7 is a side elevation view of the main rotor system of FIG. 1 primarily showing operation of mixing arm control linkages, with portions of the swashplate shown in cross section, that control pitching of the rotor blades in response to tilting the swashplate.

To assemble the swashplate 140, race ring 130 is slid over inner race sleeve 121 and the annular region formed by inner race slot 122 and race ring upper surface 132 is filled with a plurality of ball bearings 135. Alternatively, a single ball bearing assembly can be substituted for the plurality of ball bearings 135. Outer race cap 134 is screwed onto race ring 130 and the internal threads of outer race cap 134 engage the external threads of race ring 130. Check pin or anti-rotational pin 138 is inserted temporarily through check-pin through-hole 120 to engage ring notch 133 and thereby prevent rotation of race ring 130 during assembly. Race ring 130 and outer race cap 134 are adjusted to assure smooth rolling of ball bearings 135. Race locking bolts 137 are inserted through swashplate ball-links 136 and threaded holes 139 to engage locking holes 131 thereby lock race ring 130 and outer ring cap 134 against relative rotation. Adjustments for ordinary wear are accomplished by removing race locking bolts 137 and readjusting race ring 130 and outer race cap 134. The cutaway portion of swashplate 140 illustrated in FIG. 7 shows location of check-pin through-hole 120 relative to race ring 130. Swashplate 140 can be used in any application where a compact, economical, adjustable ball bearing assembly would be beneficial.

Referring again to FIG. 4, rotating first and second outer race members 130, 134 are adjustably coupled to each other. Threaded interior surface 78 of rotating second outer race member 134 is adjustably screwed onto threaded exterior surface 64 of rotating first outer race member 130. By turning rotating first and second outer race members 130, 134 in relation to each other, width 86 of outer ball bearing-receiving channel 70 is adjusted as shown, for example, in FIGS. 9 and 10. This adjustment allows a user of swashplate 140 to fine-tune the amount of ball-bearing play within swashplate 140. Such adjustment may be necessary and convenient to correct for wear in outer ball bearing-receiving channel 70 or other situations requiring bearing play adjustment.

To aid in the adjustment process, anti-rotational pin 138, as shown in FIG. 3, is included along with swashplate 140 in a swashplate kit. Furthermore, swashplate arm body 115 is formed to include anti-rotational pin-receiving aperture 120. Anti-rotational pin 138 is sized to fit within anti-rotational pin-receiving aperture 120 of swashplate arm body 115 and into anti-rotational pin-receiving detent 133 of rotating first outer race member 130. Anti-rotational pin 138 temporarily restrains the rotational capacity of rotating first outer race member 130. To secure rotating first outer race member 130 from rotational motion in relation to swashplate arm body 115, a user inserts anti-rotational pin 138 into anti-rotational pin-receiving aperture 120 of swashplate arm body 115 and anti-rotational pin-receiving detent 133 of rotating first outer race member 130. Anti-rotational pin 138 prevents rotating first outer race member 130 from turning as a user twists rotating second outer race member 134 to adjust width 86 of outer ball bearing-receiving channel 70.

Upon proper adjustment of width 86 of outer ball bearing-receiving channel 70, a user aligns plurality of threaded bolt-receiving apertures 139 of rotating second outer race member 134 with plurality of bolt-receiving apertures 131 of rotating first outer race member 130. Race locking bolts 137 are positioned to lie within bolt-receiving apertures 60 of swashplate ball-links 136 and screwed into plurality of threaded bolt-receiving apertures 139 of rotating second outer race member 134 and bolt-receiving apertures 131 of rotating first outer race member 130 thereby coupling rotating first and second outer race members 130, 134 in fixed relative motion. First and second outer race members 130, 134 are fixed in relative motion because the race locking bolts 137 prevent the first and second outer race members 130, 134 from rotating in relation to each other on threaded interior surface 78 of second outer race member 134 and threaded exterior surface 64 of first outer race member 130.

Anti-rotational pin 138 is then removed from anti-rotational pin-receiving detent 133 of rotating first outer race member 130 and anti-rotational pin-receiving aperture 120 of swashplate arm body 115.

As shown in FIGS. 3 and 4, swashplate arm body 115 further comprises a swashplate arm body base 91 formed to include an inner race member-receiving aperture 90, a plurality of fore-and-aft cyclic arms 116, fore-and-aft ball-links 118, a roll arm 117, and a roll arm ball-link 119. Fore-and-aft cyclic arms 116 include a distal end 93 and a proximal end 95 spaced apart from distal end 93 and coupled to swashplate arm body base 91. Fore-and-aft ball-links 118 are attached to distal end 93 of fore-and-aft cyclic arms 116. Roll arm 117 includes a distal end 97 and a proximal end 98 spaced apart from distal end 97 and coupled to swashplate arm body base 91. Roll arm ball-link 119 is attached to distal end 97 of roll arm 117. Fore-and-aft ball-links 118 and roll arm ball-link 119 receive pilot commands from non-rotating linkages 38 which are then transmitted through fore-and-aft cyclic arms 116 and roll arm 117, respectively, as shown, for example, in FIGS. 5 and 6. Fore-and-aft ball-links 118 and roll arm ball-link 119 are spherically shaped to allow for universal motion with non-rotating linkages 38.

The non-rotating inner race member 121 receives the pilot commands from swashplate arm body base 91. Non-rotating inner race member 121 is generally cylindrically shaped and includes an exterior surface 144 facing away from vertical main rotor axis 9 and having knurl pattern 123. Furthermore, non-rotating inner race member 121 is formed to include an upper bearing block-receiving aperture 114 having a semi-spherical top end 124 and inner ball bearing-receiving channel 122 receptive to ball bearings 135, as shown, for example, in FIGS. 3, 4, 7, and 8. In the preferred embodiment shown in the drawings, swashplate arm body 115 is made of a plastics material such as nylon that is molded directly around knurl pattern 123 and permanently secured to non-rotating inner race member 121 as shown, for example, in FIG. 4. In addition, non-rotating inner race member 121 and rotating first and second outer race members 130, 134 are manufactured from aluminum alloy.

The plurality of ball bearings 135 facilitate the transmission of the pilot control commands from non-rotating helicopter body 4 through non-rotating inner race member 121 to rotating first and second outer race members 130, 134 and rotating main rotor blades 100 and subrotor stabilizer blades 84. Inner ball bearing-receiving channel 122 of non-rotating inner race member 121 and outer ball bearing-receiving channel 70 formed by downwardly- and upwardly-facing channels 80, 66 of rotating second and first outer race members 134, 130 cooperate to hold plurality of ball bearings 135 in operational position.

Referring now to FIG. 4, to completely assemble swashplate 140, rotating first outer race member 130 is slid over non-rotating inner race member 121. Inner ball bearing-receiving channel 122 of non-rotating inner race member 121 and upwardly-facing channel 66 of rotating first outer race member 130 partially form an annularly-extending ball bearing-receiving slot 112 that is filled with plurality of ball bearings 135. Alternatively, a single ball bearing assembly can be substituted for plurality of ball bearings 135. As previously mentioned, rotating second outer race member 134 is screwed onto rotating first outer race member 130 to complete the formation of annularly-extending ball bearing-receiving slot 112. Next, race locking bolts 137 are screwed into threaded bolt-receiving apertures 139 of rotating second outer race member 134 and bolt-receiving apertures 131 of rotating first outer race member 130.

Figure 5:
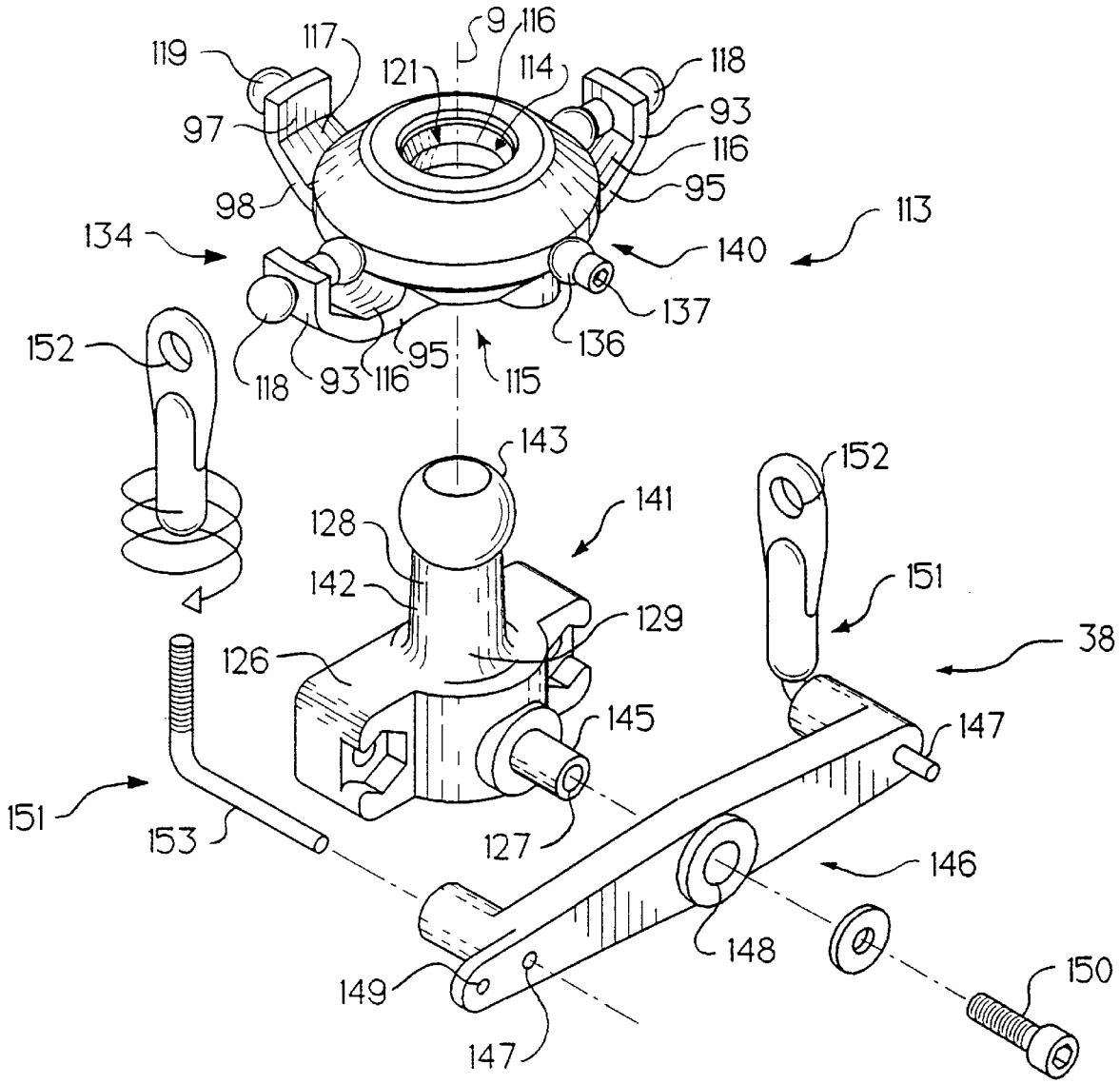
FIG. 5 is an exploded perspective view showing the main rotor system including a swashplate mounting assembly, the swashplate mounting assembly including an upper bearing block having a swashplate stalk and swashplate universal ball coupled to the swashplate stalk, a swashplate hold-down arm, and adjustable fore-and-aft cyclic links.

In FIG. 5, upper bearing block 141 includes hold-down arm pivot 145 and a generally cylindrical hollow swashplate stalk 142 terminating in swashplate universal ball 143. Swashplate hold-down arm 146 has fore-and-aft cyclic link holes or fore-and-aft cyclic link-receiving aperture 147, hold-down arm pivot hole or hold-down arm pivot-receiving aperture 148 and fore-and-aft control link hole or fore-and-aft control link-receiving aperture 149. Adjustable fore-and-aft cyclic links 151 terminate in fore-and-aft link ball-socket 152 and fore-and-aft link elbow 153.

As shown again in FIG. 5, helicopter 15 further includes a swashplate mounting assembly 113 having upper bearing block 141 that along with non-rotating linkages 38 secure swashplate 140 to helicopter 15. Upper bearing block 141 includes a bearing block base 126, hold-down arm pivot 145 coupled to bearing block base 126, a hold-down arm bolt-receiving aperture 127, generally cylindrical-shaped swashplate stalk 142 having a distal end 128 and a proximal end 129, and swashplate universal ball 143. Proximal end 129 of swashplate stalk 142 is coupled to bearing block base 126 and swashplate universal ball 143 is coupled to distal end 128 of swashplate stalk 142.

Swashplate 140 is positioned to lie on swashplate universal ball 143 making ball-joint contact with semi-spherical top end 124 of upper bearing block-receiving aperture 114 of non-rotating inner race member 121 of swashplate 140. This allows swashplate 140 to pivot universally about swashplate universal ball 143 of upper bearing block 141.

Figure 6:
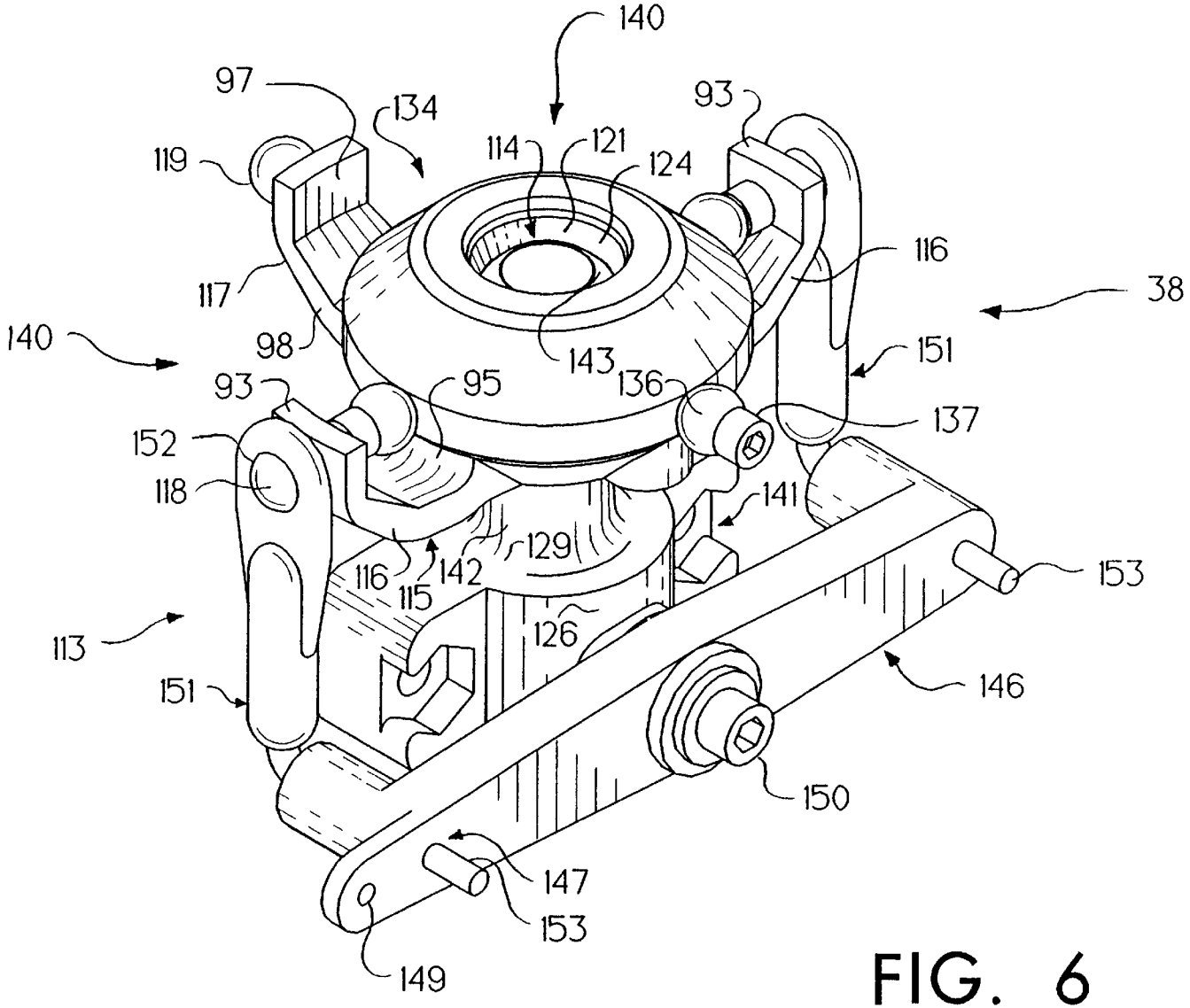
FIG. 6 is a perspective view of the swashplate mounting assembly showing the swashplate being pivotally coupled to the swashplate universal ball, the swashplate hold-down arm being pivotally coupled to the upper bearing block, and the fore-and-aft cyclic links being pivotally connected to and extending between the hold-down arm and the swashplate arm body.

As shown in FIGS. 5 and 6, non-rotating linkages 38 include swashplate hold-down arm 146 and adjustable fore-and-aft cyclic links 151 comprising fore-and-aft link ball-sockets 152 and fore-and-aft link elbows 153. Swashplate hold-down arm 146 includes fore-and-aft cyclic link-receiving apertures 147, hold-down arm pivot-receiving aperture 148, and fore-and-aft control link-receiving aperture 149.

Now referring to FIGS. 5 and 6, swashplate hold-down arm 146 is pivotally secured to upper bearing block 141 by positioning hold-down arm pivot 145 of upper bearing block 141 within hold-down arm pivot-receiving aperture 148 of swashplate hold-down arm 146 with a hold-down arm bolt 150 positioned to lie within hold-down arm bolt-receiving aperture 145. Fore-and-aft cyclic links 151 operably connect swashplate 140 to swashplate hold-down arm 146 and hold semi-spherical top 124 of non-rotating inner race member 121 against swashplate universal ball 143 thereby securing swashplate 140 to upper bearing block 141 for universal motion. Fore-and-aft cyclic links 151 also prevent rotation of swashplate arm body 115 about vertical main rotor axis 9.

Now referring to FIGS. 3, 5, and 6, swashplate hold-down arm 146 is pivotably secured to upper bearing block 141 by hold-down arm bolt 150. Fore-and-aft cyclic links 151 operably connect swashplate 140 to swashplate hold-own arm 146 and hold semi-spherical top 124 of swashplate inner race sleeve 121 against universal ball 143 thereby securing swashplate 140 to upper bearing block 141 for universal motion. Fore-and-aft cyclic links 151 also prevent rotation of swashplate arms 115 about shaft axis 9.

In operation, pilot control linkages attached to non-rotating swashplate arms 115 at roll ball-link 119 and fore-and-aft control link hole 149 can tilt swashplate 140 in any direction. Swashplate cap 134 rotates along with main rotor 1. When swashplate 140 is tilted by pilot control commands, subrotor pitch link 96 and swashplate link 73 transmit the commands to subrotor 83 and main rotor blades 100. Cyclic pitching of subrotor 83 can induce subrotor 83 to pivot cyclicly about teeter axis 82. Cyclic pivoting motion of subrotor 83 is transmitted through interconnected mixing arm 68, Z-link 74 and pitch arm 21 of pitch plate 20 to pitch plate 20 thereby cyclicly pitching rotor blades 100.

Again referring to FIG. 7, rotating linkages 36 of main rotor 1 include swashplate links 73, interconnected mixing arms 68, Z-links 74, and a pitch plate 20 having pitch arms 21. Rotating second outer race member 134 of swashplate 140 rotates along with main rotor 1 and rotating linkages 36. As shown in FIG. 7, swashplate 140 is titled. This tilted swashplate position is transmitted from swashplate 140 through swashplate ball-links 136 to attached swashplate links 73 to attached interconnected mixing arms 68 to attached Z-links 74 to attached pitch arms 21 of pitch plate 20 thereby pitching main rotor blades 100 about a pitch axis 50. The amount of tilt creates a positive or negative pitch angle 99 of main rotor blade 100. As shown in FIG. 7, pitch angle 99 of main rotor blade 100, shown in ghost lines, has a positive angle-of-attack and thus creates lift on main rotor blade 100.

Referring to FIG. 7, interconnected swashplate link 73, mixing arm 68, Z-link 74, and pitch arm 21 cyclicly transmit any tilt of swashplate 140 to pitch plate 20 and thereby to rotor blades 100. As shown in FIG. 7, swashplate 140 has been tilted to pivot rotor blades 100 about pitch axis 5 and thereby increase the pitch angle 99 of the leading edge 125 of rotor blade 100 to a positive angle-of-attack. Since two linkage paths from swashplate 140 to pitch plate 20 exist, one path is redundant. These dual linkage paths can be mechanically loaded against swashplate 140 by slightly lengthening swashplate link 73 thereby eliminating mechanical play in the linkage system. Proper spatial location of all link pivot points with respect to teeter axis 82, pitch axis 50, and swashplate 140 is essential for acceptable flight performance and to prevent binding of linkages. As linkages in one linkage path extend upward due to tilt of swashplate 140 or subrotor 83, linkages in the alternate path extend downward. Unless carefully designed, differences in the angular motions of the links can cause severe binding in some cases.

Figure 8:
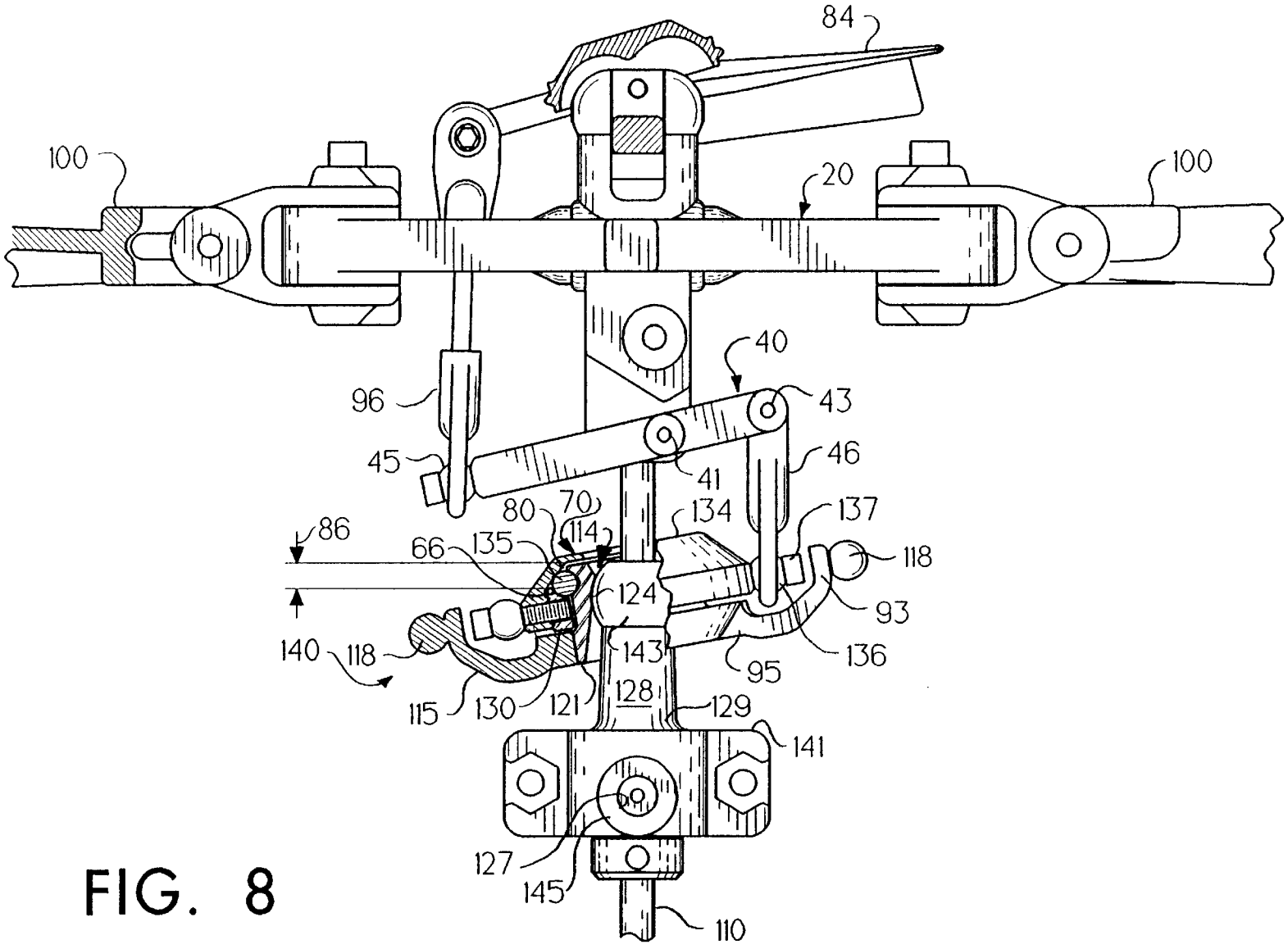
FIG. 8 is a side elevation view of the main rotor system of FIG. 1 primarily showing operation of subrotor control linkages that control pitching of the subrotor stabilizer blades in response to tilting the swashplate.
Figure 9:
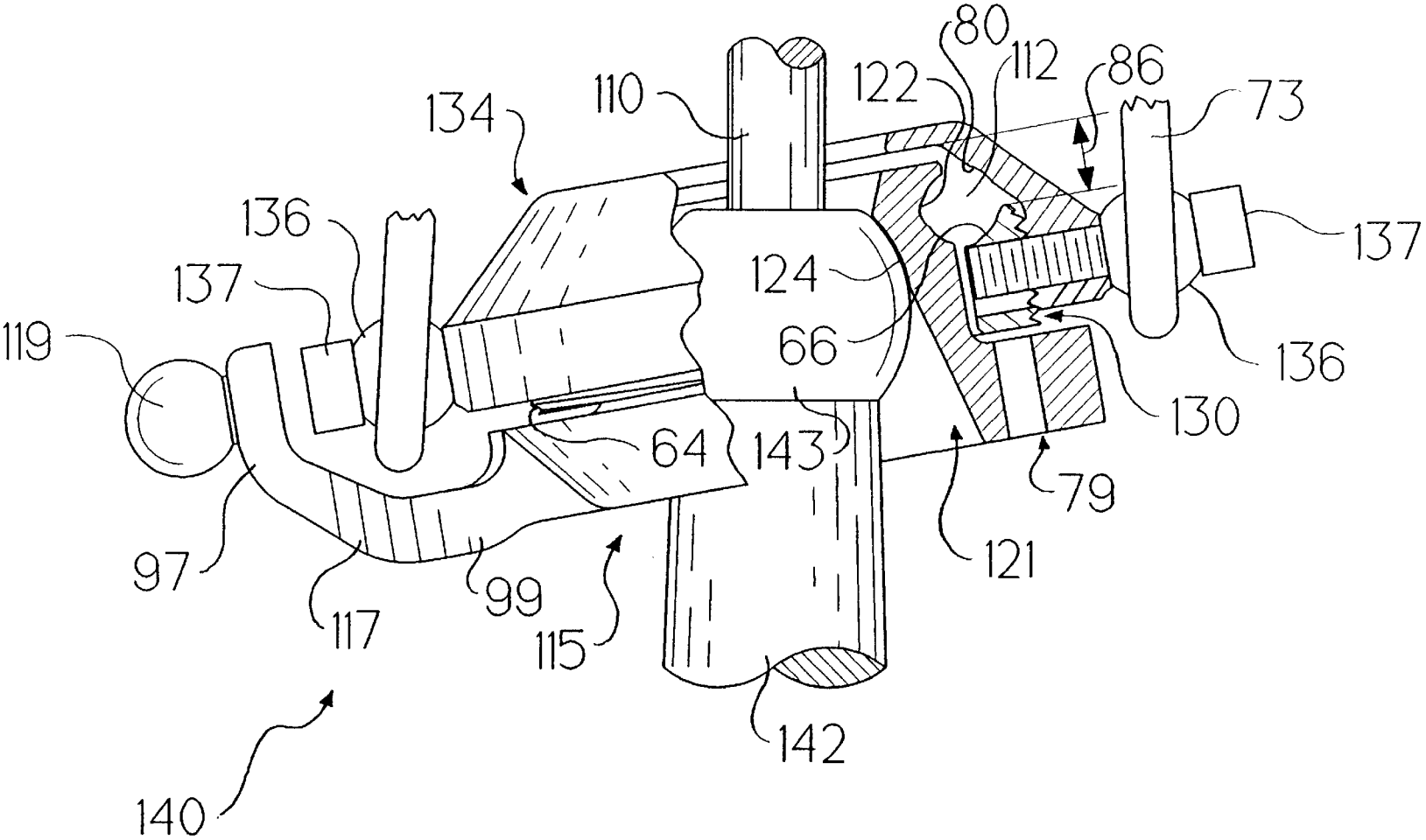
FIG. 9 is an exploded view of the swashplate of FIG. 7 (the plurality of ball bearings removed for clarity) showing the relative position of the inner race member and the first and second outer race members.
Figure 10:
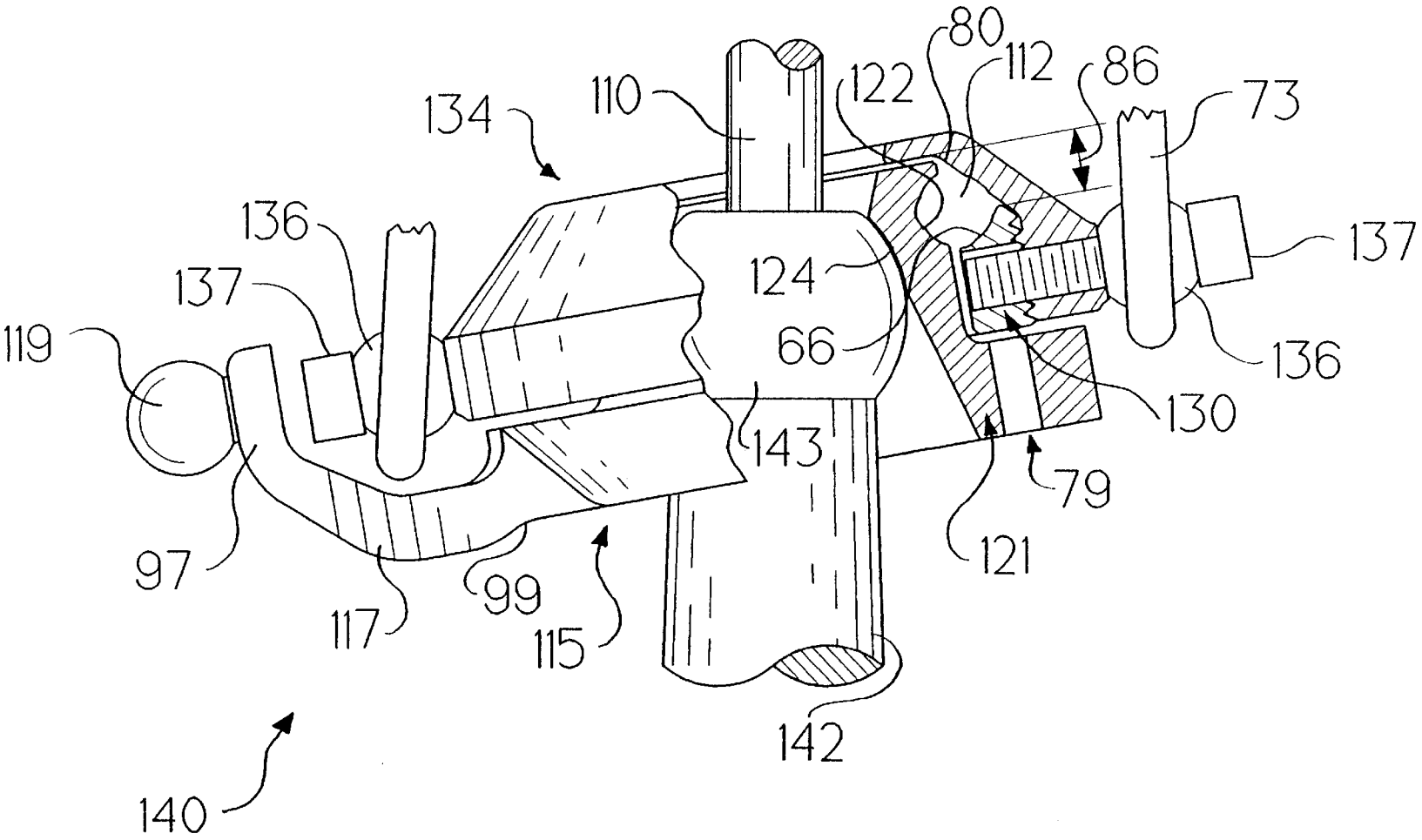
FIG. 10 is an exploded view of the swashplate of FIG. 7 (the plurality of ball bearings removed for clarity) in an adjusted position showing the relative position of the inner race member and the first and second outer race members.

The swashplate 140 further includes race locking bolts 137 and swashplate ball-links 136 coupled to rotating first and second outer race members 130, 134 as shown in FIGS. 3, 5, and 6. Swashplate ball-links 136 are spherically shaped and formed to include bolt-receiving apertures 60 that receive race locking bolts 137. Swashplate ball-links 136 and race locking bolts 137 transmit the pilot commands from rotating first and second outer race members 130, 134 to rotating linkages 36 attached to swash-plate ball-links 136, as shown in FIGS. 7 and 8. Rotating linkages 36 interconnect main rotor blades 100 and subrotor stabilizer blades 84 to swashplate 140 to transfer the pilot control commands.

In operation, pilot controls are transmitted from a non-rotating fore-and-aft control link (not shown) to fore-and-aft control link-receiving aperture 149 of swashplate hold-down arm 146. The pilot command is transmitted along swashplate hold-down arm 146 to fore-and-aft cyclic links 151 through fore-and-aft link elbows 153. Fore-and-aft link ball-sockets 152 universally transmit the pilot command from fore-and-aft cyclic links 151 to fore-and-aft ball-links 118 of swashplate arm body 115. As mentioned above, swashplate 140 then communicates the command from non-rotating linkages 38 to rotating linkages 36 and thus to main rotor blades 100 and subrotor stabilizer blades 84. Similarly, pilot control commands are also transmitted to roll arm ball-link 119 through a system of roll arm linkages (not-shown). This system of non-rotating linkages 38 allows the pilot to tilt swashplate 140 in any direction.

Since two linkage paths from swashplate 140 to pitch plate 20 exist, one path is redundant. These dual linkage paths can be mechanically loaded against swashplate 140 by slightly lengthening swashplate links 73 thereby eliminating mechanical play in the linkage system.

Now referring to FIG. 8, rotating linkages 36 of main rotor 1 further include an interconnected follower link 46, a follower arm 40, and a subrotor pitch link 96. Follower arm 40 includes a follower arm ball-link 45 and is formed to include a pivot-pin hole or follower arm pivot-pin-receiving aperture 41 and a follower arm link-pin hole or interconnected follower link-receiving aperture 43. Subrotor stabilizer blades 84 include subrotor pitch arm 21. Rotating second outer race member 134 of swashplate 140 rotates along with main rotor 1 and rotating linkages 36. As shown in FIG. 8, swashplate 140 is titled. This tilted swashplate position is transmitted from swashplate 140 through swashplate ball-link 136 to attached interconnected follower link 46 to attached follower arm 40 to attached follower arm ball-link 45 to attached subrotor pitch link 96 to attached subrotor pitch arm 21 on pitch plate 20 thereby pitching subrotor stabilizer blades 84 about a subrotor pitch axis 168.

As can be seen in FIG. 8, interconnected follower link 46, follower arm 40, and subrotor pitch link 96 cyclicly transmit any tilt of swashplate 140 to subrotor 83 causing subrotor 83 to pitch cyclicly. Unequal separation of follower ball-link 45 and follower arm link-pin hole 43 from follower arm pivot-pin hole 41 amplifies angular displacement of swashplate 140.

As previously mentioned, interconnected follower link 46, follower arm 40, and subrotor pitch link 96 cyclicly transmit any tilt of swashplate 140 to subrotor stabilizer blades 84 causing subrotor stabilizer blades 84 to pitch cyclicly. Unequal separation of follower ball-link 45 and interconnected follower link-receiving aperture 43 from follower arm pivot-pin-receiving aperture 41 amplifies angular displacement of swashplate 140.

Another feature of the present invention is the provision of simple and easy-to-manufacture control linkages. Ball joints of the type found in conventional helicopters are now replaced with Z-links or L-links that operably connect the swashplate 140, mixing arms, and the pitch plate 20. These control linkages provide redundant control paths that can be loaded to eliminate control slop in a fixed-pitch system. They also include multiple pin locations on mixing arms for different power/stability ratios.

Swashplate 140 in accordance with the present invention includes adjustable bearing races wherein the adjustable races can be screwed together and bolt means are provided to lock the races against unscrewing. Illustratively, swashplate arms are molded around the inner race sleeve. A swashplate support is also provided. An inner race sleeve engages the swashplate stalk for universal motion and the swashplate stock is connected to the main helicopter structure. Fore-and-aft cyclic links and swashplate hold-down arms secure the swashplate to the stalk and prevent rotation about the main rotor rotation axis 9. A pin hole is provided in swashplate arms and a detent is provided in the race ring to facilitate assembly.

Although the invention has been described and defined in detail with reference to certain preferred embodiments, variations and modifications exist within the scope and spirit of the invention as described and defined in the following claims.

I claim:

1. A swashplate for use in helicopters having a vertical main rotor axis, the swashplate including an inner race member, a bearing the bearing being a ball bearing, and a two-part outer race member having first and second outer race members, the inner and two-part outer race members cooperate to form a bearing-receiving chamber, the bearing being positioned to lie in the bearing-receiving chamber so that both of the first and second outer race members simultaneously engage the bearing, and the two-part outer race member being adjustable to change the size of the bearing-receiving chamber to adjust bearing play in the swashplate.

2. The swashplate of claim 1, wherein the first and second outer race members are threadingly coupled.

3. The swashplate of claim 2, wherein the first and second outer race members include a plurality of bolt-receiving apertures and the swashplate further includes a plurality of bolts positioned to lie in the bolt-receiving apertures to secure the first and second outer race members in relative rotational motion.

4. The swashplate of claim 2, wherein the inner race member is formed to include a pin-receiving hole and the first outer race member is formed to include a pin-receiving notch, the swashplate further includes a pin that is sized to fit within the pin-receiving hole and the pin-receiving notch, and the pin is positioned to lie within the pin-receiving hole and the pin-receiving notch during the adjustment of the size of the bearing-receiving chamber and is positioned to lie outside the pin-receiving hole and the pin-receiving notch during operation of the helicopter.

5. The swashplate of claim 1, wherein the first and second outer race members are releasably coupled.

6. The swashplate of claim 5, wherein the first outer race member includes a threaded exterior surface and the second outer race member includes a threaded interior surface that is releasably threaded onto the threaded exterior surface of the first outer race member.

7. A swashplate for use in helicopters having a vertical main rotor axis, the swashplate including an inner race member, a bearing, the bearing being a ball bearing, and a two-part outer race member having first and second outer race members, the inner and two-part outer race members cooperate to form a bearing-receiving chamber, the bearing being positioned to lie in the bearing-receiving chamber, and the two-part outer race member being adjustable to change the size of the bearing-receiving chamber to adjust bearing play in the swashplate, the first and second outer race members being releasably coupled, the first and second outer race members including a plurality of bolt-receiving apertures, and the swashplate further including a plurality of bolts positioned to lie within the plurality of bolt-receiving apertures to releasably couple the first and second outer race members in relative rotational motion.

8. The swashplate of claim 7, wherein the bolts include ball links and the first inner race member includes arms having ball links.

9. A swashplate for use in helicopters having a vertical main rotor axis, the swashplate including an inner race member being formed to include an inner bearing-receiving channel, a bearing, a first outer race member being formed to include an upwardly-facing channel, and a second outer race member being formed to include a downwardly-facing channel, the upwardly-facing channel of the first outer race member and the downwardly-facing channel of the second outer race member cooperating to form an outer bearing-receiving channel, the inner bearing-receiving channel and the outer bearing-receiving channel cooperating to form an annularly-extending bearing-receiving slot, the bearing being positioned to lie in the annularly-extending bearing-receiving slot, the first outer race member and the second outer race member being adjustably coupled to adjust the relative position of the upwardly-facing channel of the first outer race member and the downwardly-facing channel of the second outer race member.

10. The swashplate of claim 9, wherein the first outer race member includes a threaded exterior surface facing away from the vertical main rotor axis of the helicopter, the second outer race member includes a threaded interior surface facing toward the vertical main rotor axis of the helicopter, the threaded interior surface of the second outer race member threadingly engages the threaded exterior surface of the first outer race member to allow the adjustment of the relative position of the upwardly-facing channel of the first outer race member and the downwardly-facing channel of the second outer race member.

11. The swashplate of claim 10, wherein the first outer race member is formed to include a plurality of bolt-receiving apertures, the second outer race member is formed to include a plurality of bolt-receiving apertures, the swashplate further includes a plurality of race-locking bolts that are positioned to lie in the plurality of bolt-receiving apertures of the first outer race member and the plurality of bolt-receiving apertures of the second outer race member to prevent relative motion between the upwardly-facing channel of the first outer race member and the downwardly-facing channel of the second outer race member.

12. The swashplate of claim 11, wherein the plurality of bolt-receiving apertures of the second outer race member are threaded and the plurality of race-locking bolts are threaded and screwed into the plurality of bolt-receiving apertures of the second outer race member and the plurality of bolt-receiving apertures of the first outer race member.

13. The swashplate of claim 11, further including a plurality of swashplate ball-links coupled to the second outer race member.

14. The swashplate of claim 13, wherein the plurality of swashplate ball-links include bolt-receiving apertures, the plurality of race-locking bolts are positioned to lie in the bolt-receiving apertures of the swashplate ball-links to couple the plurality of swashplate ball-links to the second outer race member.

15. The swashplate of claim 9, wherein the first outer race member is formed to include an anti-rotational pin-receiving notch, the swashplate further includes an anti-rotational pin and a swashplate arm body coupled to the inner race member and formed to include an anti-rotational pin-receiving aperture, the anti-rotational pin is sized to fit within the anti-rotational pin-receiving aperture and into the anti-rotational pin-receiving notch of the first outer race member so that the first outer race member and the inner race member are fixed in relative motion during the adjustment of the relative position of the upwardly-facing channel of the first outer race member and the downwardly-facing channel of the second outer race member, the anti-rotational pin is removed from the anti-rotational pin-receiving notch and anti-rotational pin-receiving aperture during operation of the helicopter so that the first outer race member rotates about the vertical main rotor axis of the helicopter relative to the inner race member.

16. The swashplate of claim 9, further including a swashplate arm body coupled to the inner race member.

17. The swashplate of claim 16, wherein the swashplate arm body includes a swashplate arm body base, a plurality of swashplate arms, and a plurality of arm ball-links, the plurality of swashplate arms include a distal end and a proximal end spaced apart from the distal end and coupled to the swashplate arm body base, and the arm-ball links are coupled to the distal ends of the plurality of swashplate arms.

18. The swashplate of claim 17, wherein the plurality of swashplate arms include a plurality of fore-and-aft cyclic arms and a roll arm and the plurality of arm ball-links include fore-and-aft ball-links coupled to the distal ends of the fore-and-aft cyclic arms and a roll arm ball-link coupled to the distal end of the roll arm.

19. The swashplate of claim 16, wherein the inner race member further includes an exterior surface facing away from the vertical main rotor axis of the helicopter and the swashplate arm body is molded to the exterior surface of the inner race member.

20. The swashplate of claim 19, wherein the exterior surface of the inner race member is formed to include a knurl pattern.

21. The swashplate of claim 16, wherein the swashplate arm body is made of a plastics material.

22. The swashplate of claim 21, wherein the plastics material is nylon.

23. The swashplate of claim 9, wherein the first outer race member, the second outer race member, and the inner race member are made of a metal material.

24. The swashplate of claim 25, wherein the metal material is an aluminum alloy.

25. A main rotor system for use in helicopters having a vertical main rotor axis, the main rotor system comprising, a swashplate and a bearing block including a bearing block base, a swashplate stalk coupled to the bearing block base, and a swashplate universal ball coupled to the swashplate stalk, the bearing block further including a hold-down arm pivot coupled to the bearing block base.

26. The main rotor system of claim 25, further comprising a link connected to the hold-down arm pivot and the swashplate.

27. The main rotor system of claim 26, wherein the link transmits pilot control commands to the swashplate.

28. The main rotor system of claim 26, wherein the link constrains the swashplate on the universal ball.

29. A swashplate kit for use in helicopters having a vertical main rotor axis, the swashplate kit comprising a a swashplate including an inner race member being formed to include an inner bearing-receiving channel, a bearing, a first outer race member being formed to include an upwardly-facing channel, a second outer race member being formed to include a downwardly-facing channel, the upwardly-facing channel of the first outer race member and the downwardly-facing channel of the second outer race member cooperating to form an outer bearing-receiving channel, the inner bearing-receiving channel and the outer bearing-receiving channel cooperating to form an annularly-extending bearing-receiving slot, the bearing being positioned to lie in the annularly-extending bearing-receiving slot, the first outer race member and the second outer race member being adjustably coupled to adjust the relative position of the upwardly-facing channel of the first outer race member and the downwardly-facing channel of the second outer race member, and the first outer race member being formed to include an anti-rotational pin-receiving notch and an anti-rotational pin sized to fit within and positioned to lie in the anti-rotational pin-receiving notch of the first outer race member so that the first outer race member and the inner race member are fixed together during adjustment of the relative position of the upwardly-facing channel of the first outer race member and the downwardly-facing channel of the second outer race member and the anti-rotational pin being removed from the anti-rotational pin-receiving notch of the first outer race member during operation of the helicopter so that the first outer race member rotates about the vertical main rotor axis of the helicopter relative to the inner race member.

30. The swashplate kit of claim 24, wherein the swashplate further includes a swashplate arm body coupled to the inner race member, the swashplate arm body is formed to include an anti-rotational pin-receiving aperture, the anti-rotational pin is sized to fit within the anti-rotational pin-receiving aperture, and the anti-rotational pin is removed from the anti-rotational pin-receiving aperture of the swashplate arm body during the operation of the helicopter so that the first outer race member rotates about the vertical main rotor axis of the helicopter relative to the inner race member and the swashplate arm body.

31. A swashplate for use in helicopters having a vertical main rotor axis, the swashplate including an inner race member, a bearing, a two-part outer race member having first and second outer race members, the inner and two-part outer race members cooperate to form a bearing-receiving chamber, the bearing being positioned to lie in the bearing-receiving chamber, the two-part outer race member being adjustable to change the size of the bearing-receiving chamber to adjust bearing play in the swashplate, the inner race member being formed to include a pin-receiving hole and the first outer race member being formed to include a pin-receiving notch, and a pin sized to fit within the pin-receiving hole and the pin-receiving notch, the pin being positioned to lie within the pin-receiving hole and the pin-receiving notch during adjustment of the size of the bearing-receiving chamber and being positioned to lie outside the pin-receiving hole and the pin-receiving notch during operation of the helicopter.

32. The swashplate of claim 31, wherein the bearing is at least one ball bearing and the one ball bearing simultaneously contacts each of the first and second outer race members.

33. The swashplate of claim 31, wherein the bearing is at least one ball bearing and the at least one ball bearing rotates about an axis substantially parallel to the vertical main rotor axis.

34. A swashplate for use in helicopters having a vertical main rotor axis, the swashplate including an inner race member, a bearing, a two-part outer race member having first and second outer race members, the inner and two-part outer race members cooperate to form a bearing-receiving chamber, the bearing being positioned to lie in the bearing-receiving chamber, the two-part outer race member being adjustable to change the size of the bearing-receiving chamber to adjust bearing play in the swashplate, the first and second outer race members including a bolt-receiving aperture, and a bolt positioned to lie within the bolt-receiving aperture to secure the first and second outer race members in relative rotational motion.

35. The swashplate of claim 34, wherein the bearing is at least one ball bearing and the one ball bearing simultaneously contacts each of the first and second outer race members.

36. The swashplate of claim 34, wherein the bearing is at least one ball bearing and the at least one ball bearing rotates about an axis substantially parallel to the vertical main rotor axis.

37. A swashplate for use in helicopters having a vertical main rotor axis, the swashplate including an inner race member including a bearing-receiving channel, a bearing, a first outer race member including a channel, and a second outer race member including a channel, the channels of the first and second outer race members cooperating to form a bearing-receiving channel, the bearing-receiving channel of the inner race and the bearing-receiving channel of the first and second outer race members cooperating to form a bearing-receiving slot, the bearing being positioned to lie in the bearing-receiving slot, the first and second outer race members being adjustably coupled to adjust the relative position of the channels of the first and second outer race members.

38. The swashplate of claim 37, wherein the bearing is at least one ball bearing and the one ball bearing simultaneously contacts each of the first and second outer race members.

39. The swashplate of claim 37, wherein the bearing is at least one ball bearing and the at least one ball bearing rotates about an axis substantially parallel to the vertical main rotor axis.

40. A swashplate for use in helicopters having a vertical main rotor axis, the swashplate including a bearing, a first race member including a channel, a second race member including a channel, and a third race member including a channel, the channels of the first, second, and third race members cooperating to form a bearing-receiving slot, the bearing being positioned to lie in the bearing-receiving slot, and the first and second race members being adjustably coupled to change the respective positions of their channels.

41. The swashplate of claim 40, wherein the bearing is at least one ball bearing and the one ball bearing simultaneously contacts each of the first and second race members.

42. The swashplate of claim 40, wherein the bearing is at least one ball bearing and the at least one ball bearing rotates about an axis substantially parallel to the vertical main rotor axis.

* * * * *